United States Patent [19]

Konig et al.

[11] 4,083,171

[45] Apr. 11, 1978

[54] METHOD AND APPARATUS FOR ELIMINATING AN ABNORMALITY IN A THREAD TO BE WOUND ONTO THE BOBBIN OF AN OPEN-END SPINNING DEVICE

[75] Inventors: Reinhard Konig; Stefan Langer, both of Ingolstadt, Germany

[73] Assignee: Schubert & Salzer, Ingolstadt, Germany

[21] Appl. No.: 720,411

[22] Filed: Sep. 3, 1976

[30] Foreign Application Priority Data

Sep. 12, 1975 Germany ..... 2540703

[51] Int. Cl.[2] ..... D01H 15/00; D01H 13/16; D01H 1/12

[52] U.S. Cl. ..... 57/34 R; 57/58.95; 57/156

[58] Field of Search ..... 57/34 R, 22, 34 HS, 57/58.89–58.95, 78, 80, 83, 85, 86, 87, 156; 242/35.6 R

[56] References Cited

U.S. PATENT DOCUMENTS

| | | | |
|---|---|---|---|
| 3,128,590 | 4/1964 | Escursell-Prat | 57/34 R |
| 3,198,446 | 8/1965 | Fürst et al. | 242/35.6 R |
| 3,540,200 | 11/1970 | Tsukumo et al. | 57/34 R |
| 3,640,059 | 2/1972 | Lutovsky et al. | 57/34 R |
| 3,680,300 | 8/1972 | Landwehrkamp | 57/34 R |
| 3,695,017 | 10/1972 | Hori et al. | 57/34 R |
| 3,782,089 | 1/1974 | Landwehrkamp et al. | 57/34 R |
| 3,842,579 | 10/1974 | Bartling | 57/58.89 X |
| 3,858,385 | 1/1975 | Skinkai et al. | 57/34 R |
| 3,911,658 | 10/1975 | Smith | 57/34 R |
| 3,938,306 | 2/1976 | Bous | 57/34 R |
| 3,952,491 | 4/1976 | Sharychenkov | 57/34 R |
| 3,987,610 | 10/1976 | Stahlecker et al. | 57/34 R |

FOREIGN PATENT DOCUMENTS 1,383,091 2/1975 United Kingdom.

*Primary Examiner*—Donald Watkins
*Attorney, Agent, or Firm*—Bailey, Dority & Flint

[57] ABSTRACT

A method and apparatus for eliminating an abnormality in a thread being produced by a spinning element of an open-end spinning device and wound on a bobbin. A knotting device is placed in the path of the thread extending between the spinning element and the bobbin. A sensor senses the abnormality in the thread which may be a break or a thin or thick spot therein. If the abnormality is a break the end is placed in the spinning element for being attached to thread being produced therein. This, in turn, causes an abnormality in the thread. A cutter severs the thread at the point of abnormality and the severed portion is carried away. The knotting device is used for tying the ends of the severed thread together during the knotting operation the thread being fed from the spinning element is stored intermediate the knotting device and the spinning element and at the conclusion of the tying operation the length of thread stored intermediately is run down until completely used up. There are several modified forms of the invention disclosed in the application.

7 Claims, 25 Drawing Figures

METHOD AND APPARATUS FOR ELIMINATING AN ABNORMALITY IN A THREAD TO BE WOUND ONTO THE BOBBIN OF AN OPEN-END SPINNING DEVICE

BACKGROUND OF THE INVENTION

The present invention refers to a method and apparatus of eliminating an abnormality in a thread to be wound onto the bobbin of an open-end spinning device by removing the abnormality from the thread and using a knotting device to tie the severed ends of the thread back together.

The practice is already known of eliminating a thread breakage in an open-end spinning device and at the same time doing away with the point of attachment by means of a knotting device (West German O/S 1952106, 2133135 and 2211514). For this purpose an auxiliary thread is introduced into the spinning device, which thread then has to be connected with the end of the thread which is on the bobbin. Because of the feed device for the auxiliary thread these devices are as a rule very costly and are also not certain enough in operation.

SUMMARY OF THE INVENTION

The above problem is solved if the thread which is on the bobbin is drawn from the bobbin, attached and subsequently drawn from the spinning element, and if the point of attachment is severed from the thread and carried away and the two resultant thread ends are connected together by knots. In this way the point of attachment is eliminated from the thread. The device in accordance with the invention is controlled by timing circuits or monitors so that the separated piece of thread with the point of attachment lies in the zone of an auxiliary draw-off device. Advantageously the thread delivered afterwards by the spinning element during the knotting is stored intermediately and after the conclusion of the knotting process the length of thread stored intermediately is run down again until completely used up.

In order to avoid further withdrawal of thread from the bobbin after the first withdrawal of the thread from the bobbin for the formation of spare loops and for the attachment of the thread, which is not without problems, in accordance with a modified form of the invention first, a portion of the thread is pulled down from the bobbin necessary for the attachment and knotting and is stored pneumatically. The lengths of thread necessary to form detoured loops are subsequently taken from the stored lengths of thread. The detoured loops are formed in sequence from the bobbin in the direction towards the storage. In this way, because of the tension exerted on the thread in forming of the detoured loops, the thread is taken from the stored length of thread rather than being pulled down from the bobbin.

At higher operating speeds it is advantageous if attachment of the thread is effected at a low speed of draw-off of the thread, whilst the knotting process with severing of the sections of thread which are not maintaining the count is effected at full speed of draw-off of the thread. In order that thread draw-off shall start always at the correct instant, the restored thread tension may effect starting of thread draw-off via the thread monitor. Since the bobbin because of its mass is inert and therefore a certain time is needed until it reaches full winding speed, the bobbin is advantageously brought into contact with its driving roller already before the conclusion of the knotting process. It is advantageous if a spare loop is formed before the knotting process between the knotting device and the bobbin, which is run down during the knotting process.

Run-down of the length of thread stored intermediate the knotting device and spinning element may be effected in various ways, for example, as a result of tensioning of the yarn during winding-up. Advantageously this run-down may also be effected by slight reduction of the thread draw-off.

Abnormalities such as thick or thin spots in the thread may likewise be eliminated by means of the method in accordance with the invention. In accordance with the invention for this purpose in an uninterrupted spinning process the thread is led through the knotting device in the form of a loop, and upon the occurrence of such an abnormality in the thread it is transferred up to and into the loop led through the knotting device, whereupon the knotting device comes into action so that the piece of thread with the abnormality gets severed and carried away. It is however, equally possible in an uninterrupted spinning process to lead the thread through the knotting device and upon the occurrence of an abnormality in the thread to deflect the piece of thread before the knotting device from the normal run of the thread and sever it. Each of the two ends of the thread are seized and the end of the thread being delivered from the spinning element is inserted into the knotting device, whereupon the two ends of the thread are knotted together and the superfluous ends of thread are severed and carried away.

For performance of the method the device may be formed in various ways. In accordance with a preferred embodiment of the invention an auxiliary thread-draw device positioned directly next to the run of the thread is arranged between the spinning device and the knotting device. An end of a thread-draw device which is pivotable into the run of the thread between the knotting device and the bobbin, and in addition a thread deflector member which deflects the thread into a loop and feeds it to a thread severing device is provided as well as an auxiliary thread-draw device which lies between the thread severing device and the knotting device in the run of the deflected thread. In accordance with another embodiment of the invention, a movable thread deflector member is provided, which feeds the thread to a knotting device and to an auxiliary thread-draw device associated with the latter.

In order not to have to pull the thread for the detoured loops from the bobbin, in accordance with the invention a yieldable thread-retainer device is provided before the thread storage device with respect to the direction of draw of the thread, with which is associated a thread-severing device. The auxiliary thread-draw device is advantageously formed as a suction device.

By means of the device and method in accordance with the invention, the feed of an auxiliary thread is avoided. Hence, the elements necessary to this feed may be omitted, whereby the device becomes easier to supervise, simpler and more certain in operation. During the knotting process the thread is stored intermediately before the knotting device, whereby the draw-off of the thread is not disturbed. Furthermore, the device in accordance with the invention makes it possible that not only can a thread breakage be eliminated or a normal attachment of thread breakage be eliminated or a normal attachment of thread be effected after a stoppage of the spinning unit but furthermore, enables also supervision of the thread for thick or/and thin spots and their elimination.

The invention is explained below with the aid of some examples, only the parts absolutely necessary to the understanding of the invention being shown in the drawings.

Accordingly, it is an object of the present invention to provide a method and device for eliminating yarn abnormalities from thread being produced on open-end spinning devices.

Another important object of the present invention is to provide a method and device for removing yarn abnormalities from a thread being produced on an open-end spinning machine which may be in the form of thin and thick spots or attachments resulting from connecting breakages in the yarn by removing the abnormality from the thread and tying the resulting severed ends of the thread together with knots.

Another important object of the present invention is to provide a method and apparatus for removing yarn abnormalities from thread being produced on an open-end spinning machine without adversely affecting the operation of the production of thread.

These and other objects and advantages of the invention will become apparent upon reference to the following specification, attendant claims and drawings.

DESCRIPTION OF A PREFERRED EMBODIMENT

Figure 1:
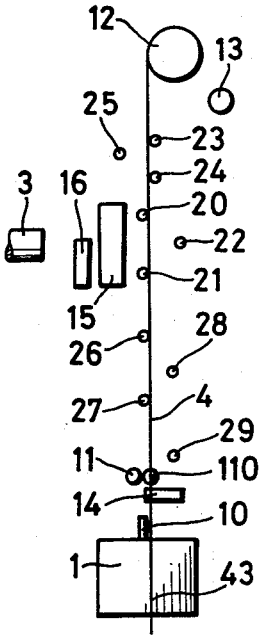
FIGS. 1 to 5 illustrate diagrammatically a first embodiment of the invention in the different phases of operation.

In order to avoid later elimination of the points of attachment by knotting during a separate rewinding process, the knotting process is performed on the open-end spinning machine. In accordance with the known methods an auxiliary thread is used, whereby the elements necessary to the elimination of the points of attachment must be further added to by devices for the feeding of an auxiliary thread one end of which is fed to the collecting surface of the spinning device and the other end of which must be connected to the thread which is on the bobbin.

The present invention avoids the auxiliary thread, whereby the device becomes simpler, easier to supervise and more certain in operation. The method in accordance with the invention can be performed by means of various devices. Consequently the invention is to be explained below with the aid of three embodiments.

A first embodiment is shown by FIGS. 1 to 5 which illustrate the object of the invention diagrammatically. During the normal course of spinning the thread 4 extends from the spinning element (not shown) of the spinning device 1 from which it is drawn away through an outlet tube 10 by means of draw rollers 11, 110, to the bobbin 12 which is driven by means of a driving roller 13.

The thread 4 on its way between the outlet tube 10 and the draw rollers 11, 110 passes a thread-monitor 14 which supervises the thread tension. In case it is required a monitor can in addition be provided which supervises the thread thickness, which in the case of appropriate design of the thread monitor can also be done by this itself (U.S. Pat. application Ser. No. 694,806).

Between the spinning device 1 and the bobbin 12 is a knotting device 15. On the side of it facing the run of the thread two thread guides 20 and 21 are provided, between which a thread-deflector member 22 can be moved transversely to the run of the thread through the knotting device 15 up to and into the region of an auxiliary thread-draw device 3 which advantageously is formed as a suction device. Between the knotting device 15 and the auxiliary thread-draw device 3 a further thread-monitor 16 is arranged.

Before and after the knotting device 15, referred to the run of the thread, there are in each case further thread guides 23, 24 and 26, 27 with which in each case is associated a thread-deflector member 25 and 28 movable transversely to the run of the thread. In the embodiment shown, a further thread-deflector member 29 is arranged between the spinning device 1 and the thread guide 27.

Figure 2:
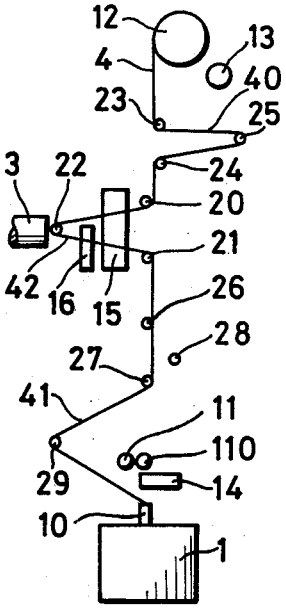

If the thread monitor 14 establishes a thread breakage or other fault the spinning unit is stopped in known manner. The operator is directed towards the fault by a signalling device (not shown). He lifts the bobbin 12 off the driving roller 13, looks for the end of the thread which is on the bobbin 12, pulls the thread 4 down from the bobbin 12 and brings it by severing of the end, which is unsuited for thread attachment, to the correct attachment length (FIG. 1). By shifting of the thread-deflector members 25, 22 and 29 spare loops 40 and 41 as well as a loop 42 necessary to the knotting are formed, whereupon the free thread end 43 is introduced into the outlet tube 10 of the spinning device 1 (FIG. 2). In a suitable way the spare loop 41 for the thread attachment is now released, the bobbin 12 is lowered onto the driving roller 13, the thread 4 is introduced into the pinch between the draw rollers 11, 110 and the fibre feed into the spinning device 1 is switched on.

The formation of the spare thread can be performed in various ways, e.g., whether by leading roundabout as a spare loop 41, by reverse rotation of the draw rollers 11, 110 or in any other suitable way. These processes are, however, not the object of this invention. For example, a switching member is arranged on the bobbin holder for a switch (West German O/S 2 058 603) which controls the various processes. The thread deflector member 29 is formed, for example, as the retractable core arranged on a rail (West German O/S 1 960 562, FIG. 3), of an electromagnet which is actuated by the above-mentioned switch. The introduction of the thread 4 into the pinch between the draw rollers 11, 110 may be effected by appropriate forming of the rollers (chamfering or a notch). Lowering of the bobbin holder is effected in that case by hand.

But the switch may also be arranged at any point and actuated directly by hand. The bobbin 12 is in that case supported by a supporting element 120 (FIG. 15) which can be retracted and thereby releases the bobbin 12. The supporting element 120 will be explained again in further detail in connection with FIG. 15.

Figure 3:
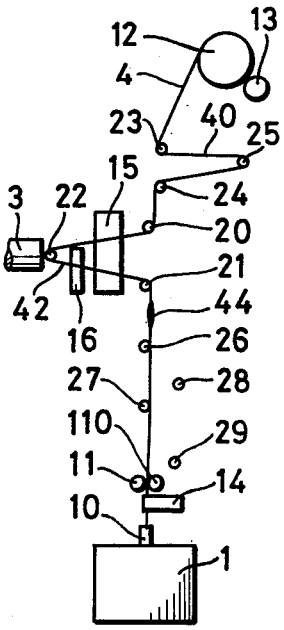
Figure 4:
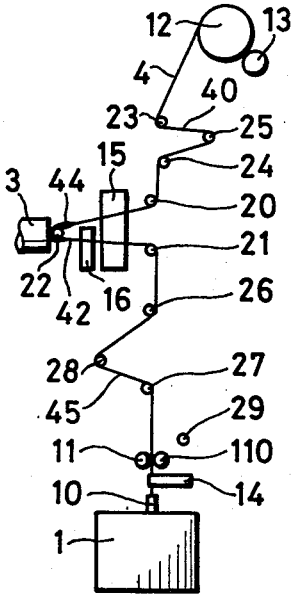
Figure 5:
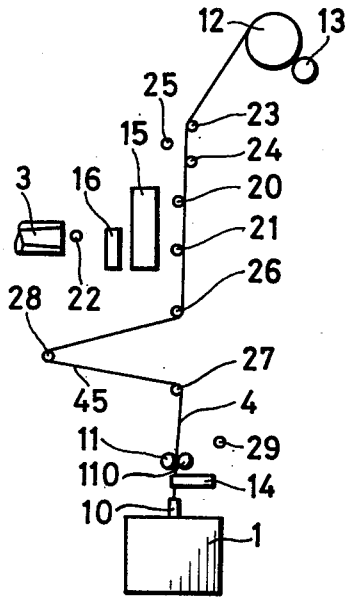

The thread 4 is now drawn off, the point of attachment 44 which forms an abnormality being drawn out of the spinning device 1 and travelling to the knotting device 15 (FIG. 3). When the point of attachment 44 reaches the thread monitor 16 the thread 4 is stopped in the knotting device 15 and the knotting device 15 is brought into action. For stopping the thread 4 in the knotting device 15 during the knotting process the spare loop 40 is run down, whilst for taking up the thread 4 drawn off from the spinning device 1 by the draw rollers 11, 110, a spare loop 45 is formed between the draw rollers 11, 110 and the knotting device by means of the thread deflector member 28 (FIG. 4). In the knotting device 15 a knot is formed in the thread 4, and the loop 42 with the point of attachment 44 is severed by the knotting device 15 from the remaining thread 4 and carried away by the auxiliary thread-draw device 3 (FIG. 5). The length of thread stored intermediately in the spare loop 45 is during the subsequent spinning gradually reduced by tensioning or else also by a small reduction in the speed of the draw rollers 11, 110 until the spare loop 45 is completely used up. The reduction in speed in that case is effected so gradually that the yarn count is affected only so insignificantly that the change still lies within the range of tolerance.

Naturally certain modifications of the method described are possible. Thus, the spare loop 45 may also be formed by the thread-deflector member 29 between the draw rollers 11, 110 and the thread guide 27, so that the thread guide 26 and the thread-deflector member 28 may be omitted. The spare loop 45 serving as intermediate storage may also be formed pneumatically by means of a suction tube 280 (FIGS. 6 to 15). Also, the spare loop 40 may be formed only after successful attachment, in which case, however, the bobbin 12 is still lifted off its driving roller 13. Only after successful formation of the spare loop 40 is the bobbin 12 lowered onto its driving roller 13, which may be controlled by a limit switch (not shown) associated with the thread-deflector member 25.

It is also possible to control the start of thread drawing by the thread monitor 14. For example, the draw rollers which include a pressure roller 110 is set against the counter-roller 11 upon re-established thread tension being signalled by the thread monitor 14. The roller 11 is already being driven and begins driving roller 110 when brought in contact therewith.

Instead of the thread monitor 16 an appropriate time control device may also be provided, which is controlled by the thread monitor 14 and which, in turn, after a period of time based on the thread draw speed, controls the knotting device 15 as well as the thread-deflector members 25 and 28.

Attachment of the thread 4 is effected advantageously at low thread-draw speed, since in this way the security of attachment may be increased. Only after successful attachment but before knotting may the spinning unit be run up to full thread-draw speed, so that the knotting process and severing of the loop 42 with the point of attachment 44 are effected at full thread-draw speed. Obviously the speed ratios between the driven elements (fibre feed, rotor r.p.m., thread draw, thread winding) must moreover remain constant in order to avoid changes in the yarn characteristic.

Figure 13:
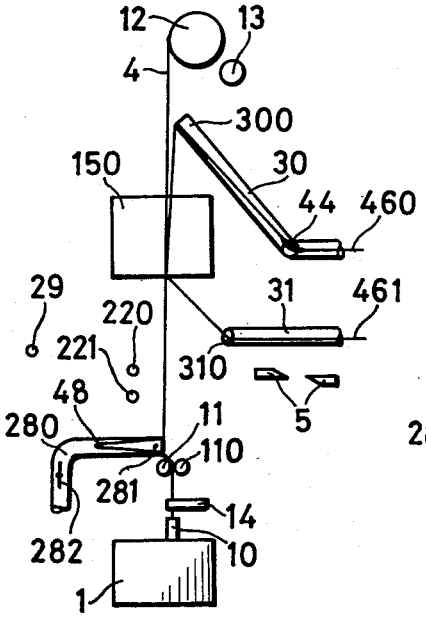
Figure 14:
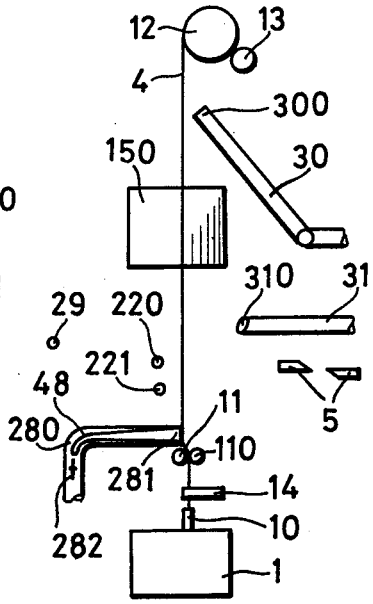
Figure 15:
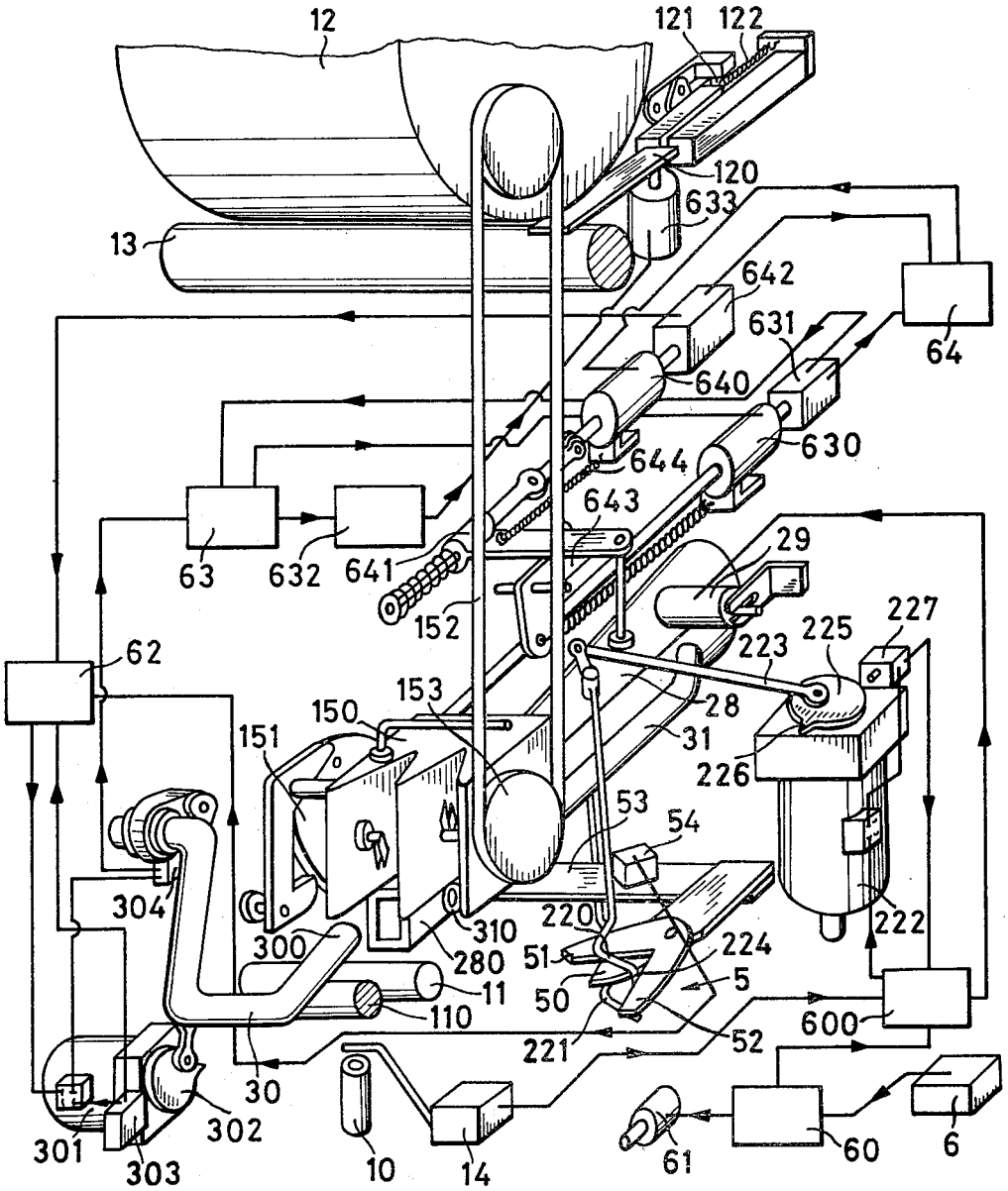
FIG. 15 is a perspective view of the device for thread attachment as shown in FIGS. 6 to 14, together with the control connections.

In FIG. 15, another embodiment of the invention is shown, the way of operation of which is explained with the aid of the diagrammatic illustrations of FIGS. 6 to 14.

In the normal course of spinning the thread 4 on the way from the spinning device 1 to the bobbin 12 passes through the outlet tube 10, and by the thread monitor 14, the draw rollers 11, 110 and the knotting device 150. Between the draw rollers 11, 110 and the knotting device 150 is the suction tube 280. Opposite the mouth 281 of this suction 280 lies the mouth 300 of a pneumatic gripper 30.

The mouth 300 of this gripper 30 may by swivelling be brought into the run of the thread between the knotting device 150 and the bobbin 12. Between the outlet tube 10 and the knotting device 150 a thread-deflector member 29 is arranged for thread attachment. Between the draw rollers 11, 110 and the knotting device 150 are arranged two thread-deflector members 220 and 221 which can be moved together transversely to the run of the thread and by which the thread 4 can be fed in the form of a loop 46 (FIG. 10) to a thread-severing device 5. In the run of the thread along this loop 46 between the thread-severing device 5 and the knotting device 15, lies the mouth 310 of a suction tube 31.

Figure 6:
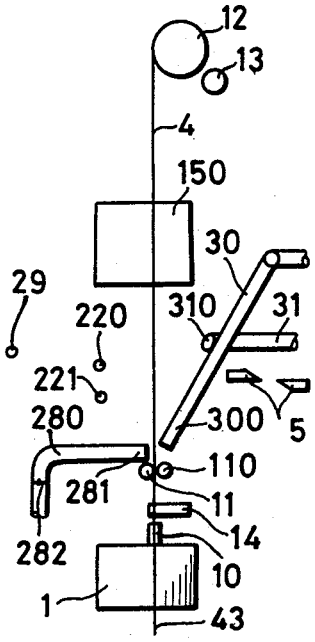
FIGS. 6 to 14 illustrate diagrammatically a second embodiment of the invention in the different phases of operation.
Figure 7:
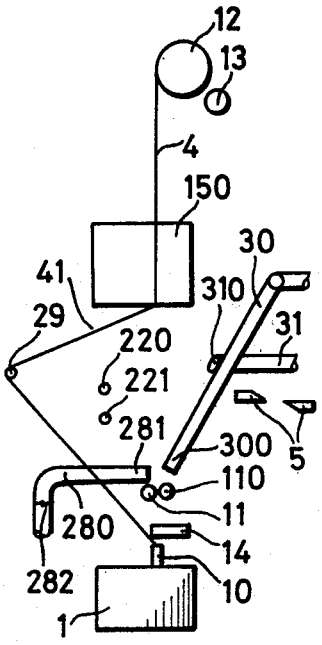
Figure 8:
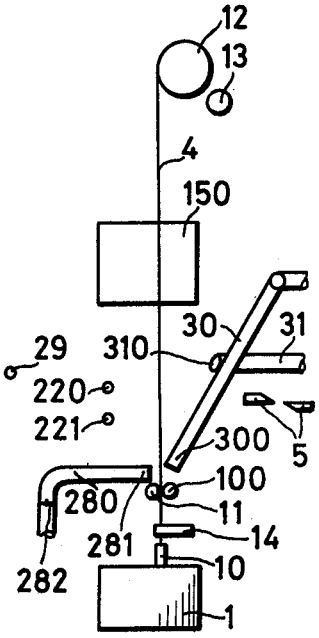
Figure 9:
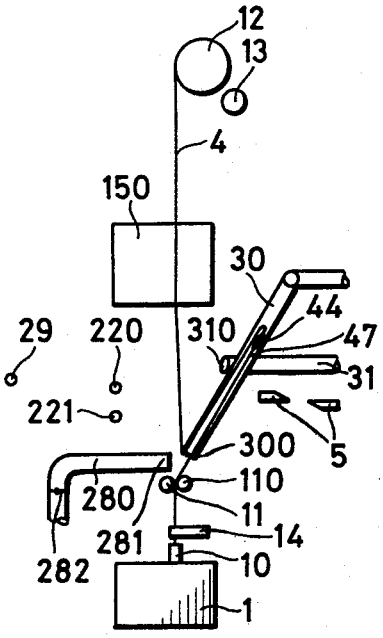
Figure 10:
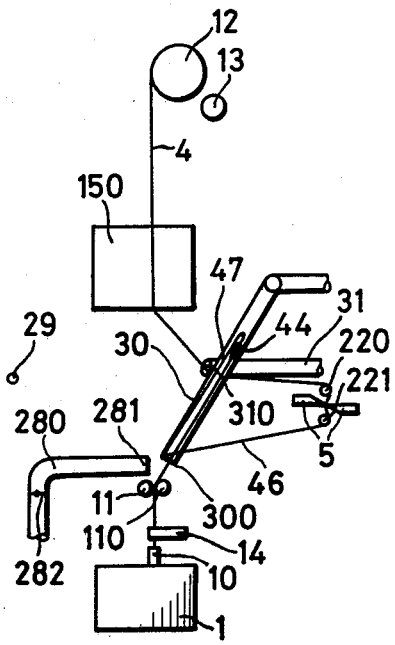

Upon the occurrence of a thread breakage, the operator lifts the bobbin 12 off its driving roller 13 and supports it by a supporting element 120 which is secured in the lifted position by a pin 121 which catches behind the end of it. Now the operator looks for the free end of the thread, pulls the thread 4 down from the bobbin 12 and brings it by severing of the end which is unsuited to thread attachment, to the correct attachment length (FIG. 6). The operator now guides the thread 4 round the thread-deflector member 29 and introduces the free end 43 of the thread into the outlet tube 10 of the spinning device 1 (FIG. 7). By actuation of a switch 6 (FIG. 15) a control unit 60 is switched on for the control of a coupling or a magnet 61 for the switching-on of the fibre feed into the spinning device 1. Via a delay device 600 the spare loop 41 is released by the thread-deflector member 29 and delivered back to the spinning device 1 (FIG. 8). The thread 4 with the point of attachment 44 drawn by the draw rollers 11, 110 from the spinning device 1 is stored by the reduced pressure acting in the pneumatic gripper 30 in the form of a loop 47. After the thread monitor 14 has signalled the presence of normal thread tension a motor 222 is switched on, which swivels the thread-deflector members 220 and 221 via a linkage 223. During their swivelling motion the thread-deflector members 220 and 221 seize the thread 4 and deflect it past the mouth 310 of the suction tube 31 into a loop 46 up to and into the region of the thread-severing device 5 (FIG. 10). The thread-severing device 5 exhibits a stationary knife edge 50 as well as a knife edge 51 which is connected to a driving arm 52 and is supported pivotally on the extended knife edge 50. A spring (not shown) associated with the movable knife edge 51, is loaded to open the thread-severing device 5 and to turn the knife edge 51 clockwise. The thread-deflector members 220 and 221 exhibit a connecting piece 224 which during the pivotal motion of the thread-deflector members 220 and 221 runs up against the driving arm 52 and moves the knife edge 51 towards the stationary knife edge 50 against the action of the said spring. The thread-deflector members 220 and 221 are formed in the shape of a hook so that it is ensured that the loop 46 arrives exactly between the knife edges 50 and 51 of the thread-severing device 5 and gets severed.

Figure 11:
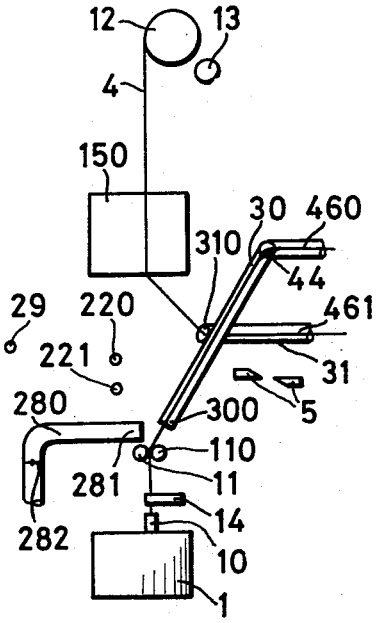

The two resultant ends 460 and 461 of the thread are sucked into the pneumatic gripper 30 and into the suction tube 31 (FIG. 11).

On the shaft of the motor which drives the linkage 223 for the thread-deflector members 220 and 221 a switching disk 225 is provided, having a cam 226 for actuation of a switch 227 for switching off the motor 222 (FIG. 15) when the switching disk 225 has turned 360 degrees and the thread-deflector members 220 and 221 have returned to their starting position.

Figure 12:
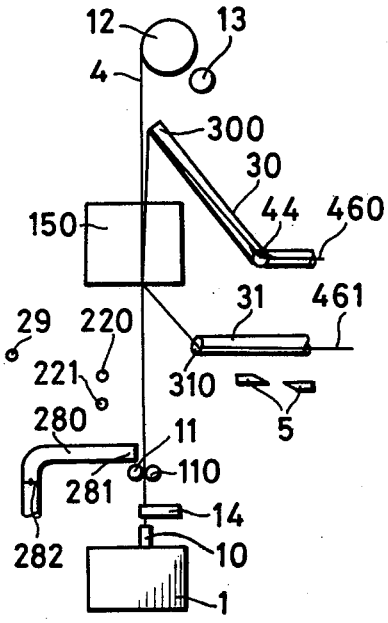

A switch 54 which controls the further processes via a control device 62 is arranged on the mounting 53 of the thread-severing device 5. The control device 62 switches on a motor 301 for swivelling the pneumatic gripper 30, the mouth 300 of which thereby arrives in the run of thread between the knotting device 150 and the bobbin 12 (FIG. 12).

In the upper position of the mouth 300 of the pneumatic gripper 30 a switching disk 302 fitted to the shaft of the motor 301 actuates a limit switch 303 by which the motor 301 is stopped (FIG. 15). Hence, there are two thread ends 461 and 460 extending in opposite directions through the knotting device 150.

By a further limit switch 304, which is associated with the pneumatic gripper 30 or else equally well by the limit switch 303, a further control device 63 is switched on for acutation of the knotting device 150. The control device 63 controls a magnet 630 which releases the coupling 151 via a linkage 154 so that the knotting device 150 is driven through one revolution via the belt 152 and the driving disks 153. At the same time a locking hook 643 is swung downwards by the linkage 154 and releases a linkage 641 for control of a valve 282 (FIG. 13) in the suction tube 280. The valve 282 is now opened under the action of a spring 644. Hence during the operation of the knotting device 150 the thread drawn out of the spinning device 1 by the draw rollers 11, 110 gets stored intermediately as a spare loop 48 in the suction 280 (FIG. 14).

By the control device 63 a relay device 632 is switched on, which actuates with a time delay a magnet 633 for raising the pin 121 (FIG. 15). The supporting element 120 is pulled away by a tension spring 122 from under the bobbin 12 so that the latter rests against the driving shaft 13 again and is driven. During the subsequent spinning the spare loop 48 in the suction tube 280 is gradually run down to nothing. The magnet 630 in its end position operates a limit switch 631 which blocks the current supply to the magnet 630 via a control device 63 and at the same time switches on a control device 64.

The control device 64 which has a longer time delay, actuates the magnet 640, which closes the valve 282 (FIG. 14) via the linkage 641. By the locking hook 643 catching in the linkage 641 the valve 282 is held in the closed position. The magnet 640 in its end position actuates a limit switch 642. which interrupts the current supply to the magnet 640 via a control device 64. The control device 62 is switched on again too by the limit switch 642 and swivels the pneumatic gripper 30 back into the normal position (FIG. 14) via the motor 301.

The invention is not restricted to the two embodiments which have been described but may be modified in many ways. FIGS. 16 to 20 show an embodiment which operates essentially in accordance with the principle which has been described with the aid of FIGS. 1 to 5.

Figure 25:
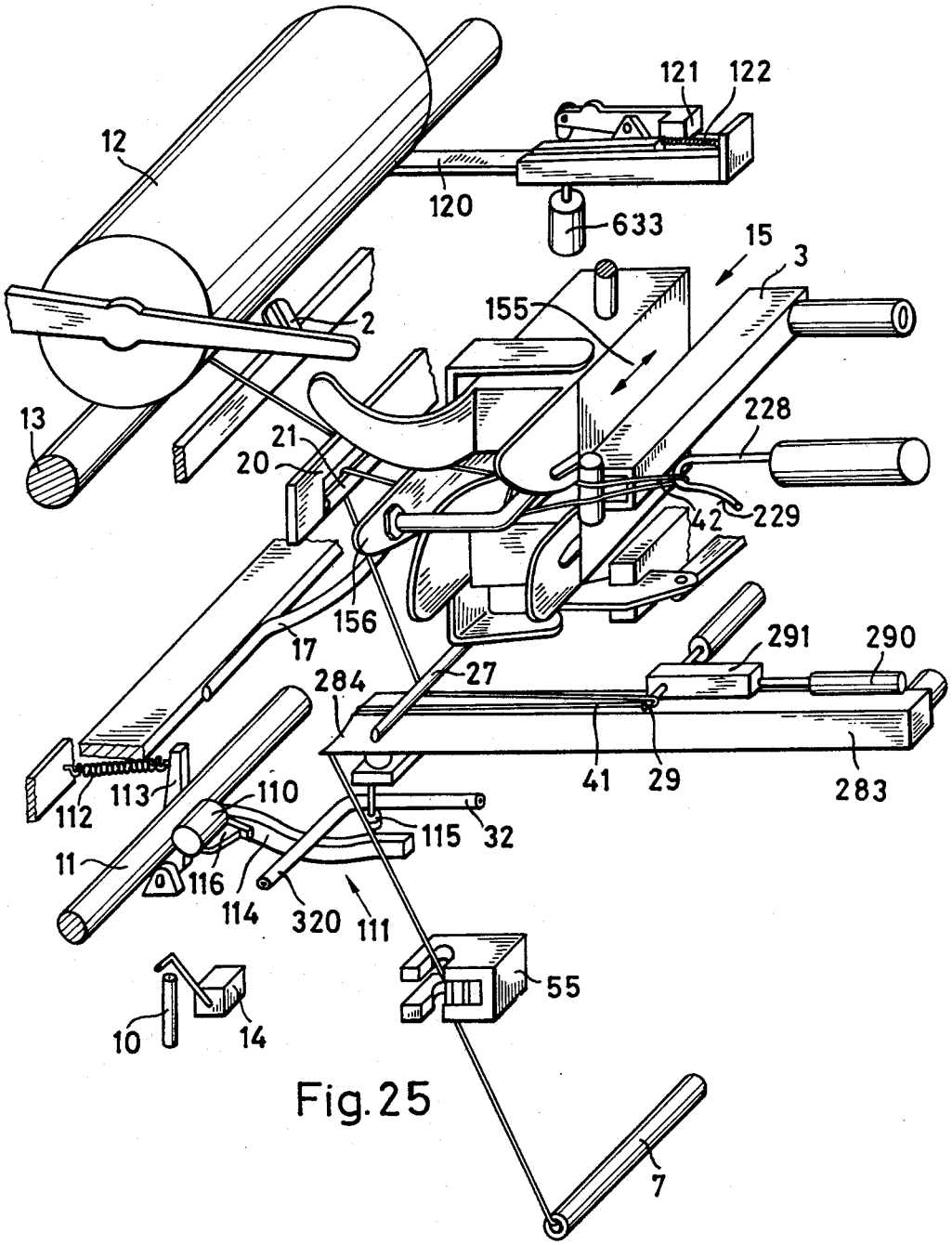
FIG. 25 is a perspective view of the device for thread attachment as shown in FIGS. 16 to 24.

During the normal spinning process the thread 4 on the way from the spinning device 1 to the bobbin 12 passes through the outlet tube 10, and by the thread monitor 14 and the draw rollers 11, 110 (FIG. 25). While the thread 4 is being traversed by the thread guide 2 it runs in the usual way over a thread tension equalizer stirrup 17 (FIG. 25). Between the draw rollers 11, 110 and the bobbin 12 there is also in the case of this embodiment of the object of the invention arranged the knotting device into which the thread 4 gets inserted by means of a hook-shaped thread-deflector member 228. Underneath the knotting device 15 a thread guide 27 is arranged. Between this thread guide 27 and the draw rollers 11, 110 lies the thread-deflector member 29.

In the embodiment of the invention described with the aid of FIGS. 1 to 5 a further thread-deflector member 28 is arranged between the knotting device 15 with the thread 20 and 21 and the draw rollers 11, 110. In the embodiment shown in FIGS. 16 to 26 this thread-deflector member is substituted by a suction tube 283 which may be brought into and out of the run of the thread. This suction tube 283 forms just like the suction tube 280 in the embodiment in accordance with FIGS. 6 to 15, a thread storage device. Before the suction tube 283 in the direction of draw a yieldable thread retaining device 7 is located. This may be of any form, but preferably it is formed as a suction tube. A thread-severing device 55 is associated with the thread retaining device 7, being arranged between the thread retaining device 7 and the thread guide 27.

Furthermore, a suction tube 32 is provided wherein the mouth 320 of which is so arranged that a thread 4 led to the thread severing device 55 from the mouth 284 of the suction tube 283, which in the working position lies in the run of the thread, passes by the mouth 320.

Upon reference of a thread breakage the spinning unit is stopped in known manner by the thread monitor 14 and the fault is indicated. The operator lifts the bobbin 12 off the driving roller 13 and supports it by a supporting element 120 which is secured in the lifted position by a pin 121 which catches behind the end of it.

Figure 16:
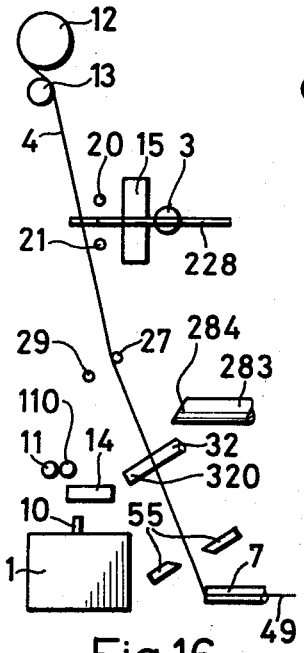
FIGS. 16 to 24 illustrate diagrammatically a third embodiment of the invention in the different phases of operation.
Figure 17:
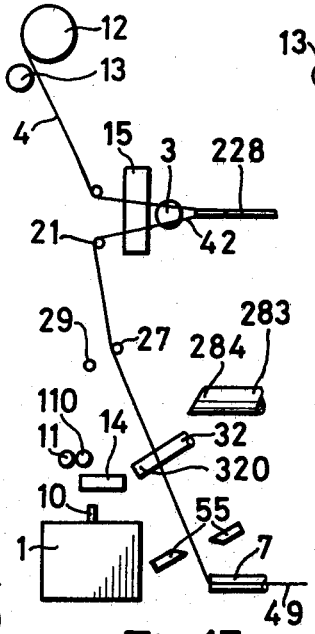
Figure 18:
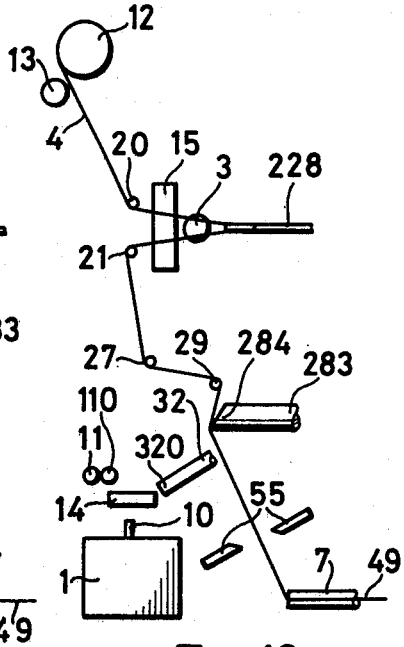

At a given instant, for example, by actuation of a switch (not shown) or by response of the thread monitor 14 upon the occurrence of the thread breakage, the hook-shaped thread-deflector member 228 moves into the receiving position. The operator now looks for the free end 49 of the thread on the bobbin 12, pulls a fairly long length of thread down from the bobbin 12 and introduces the thread as spare thread into the thread-retaining device 7 (FIG. 16). In a suitable way, for example, by means of a light barrier (not shown) fitted to the thread retaining device 7, a drive (not shown) for the hook-shaped thread-deflector member 228 is actuated by the presence of the thread in thread-retaining device 7, and this now deflects the thread in the form of a loop 42 (FIG. 17). If necessary, the knotting device 15 can for this purpose be brought in the direction of the arrow 155 out of the way of the thread-deflector member 228 (FIG. 25). But now the knotting device 15 may be brought into the operation position again, for example by a limit switch (not shown) associated with the thread-deflector member 228, in which case the thread 4 is threaded correctly into the knotting device 15 by the lead-in plate 156. In a suitable way, for example, by a limit switch (not shown) associated with the knotting device 15, the thread-deflector member 29 is now actuated (FIG. 18). In accordance with the embodiment shown (FIG. 25) this is done pneumatically by means of a control cylinder 290 to and from which the air is led by pipes (not shown).

Figure 19:
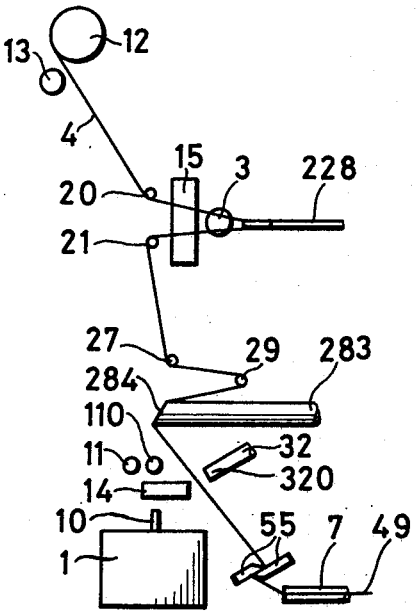

In this case, the thread 4 passes by the mouth 284 of the suction tube 283, which for this purpose may be formed in a V-shape as a thread guide. The suction tube 283 is brought into the working position in the normal run of the thread (FIG. 25). The thread 4 now extends between the thread-retaining device 7 and the bobbin 12 in an essentially zig-zag path and forms two loops 41 and 42 (FIG. 19). The lengths of thread necessary for this are in this case taken away from the length of thread being stored by the yieldable thread retaining device.

The pressure roll 110 is now lifted away from the continuous draw-shaft 11. For this purpose, for example, the pressure roller 110 is carried by a two-armed lever 111 one arm 113 of which is subjected to the action of a spring 112 so that the pressure roller 110 carried by the other arm 114 is normally held in contact against the continuous draw-shaft 11 (FIG. 25). The free end of the arm 114 in that case rests against a controllable pin 115 by means of which the pressure roller 110 is lifted against the action of the spring 112 away from the draw-shaft 11. The pin 115 may in that case be controlled in any way, e.g., pneumatically or magnetically.

Figure 20:
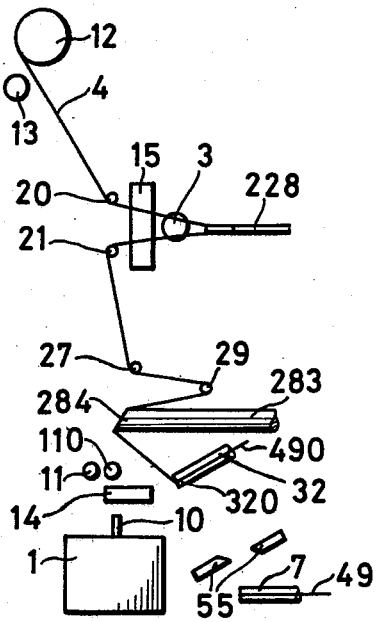

The thread-severing device 55 is now actuated by, e.g., a limit switch (not shown) associated with the suction tube 283 and the thread is brought to a certain length (FIG. 19). The severed end 49 of the thread is carried away by the yieldable thread retainer device 7 while the remaining end 490 of the thread gets sucked into the suction tube 32 past the mouth 320 of which it has been closely led (FIG. 20).

Figure 21:
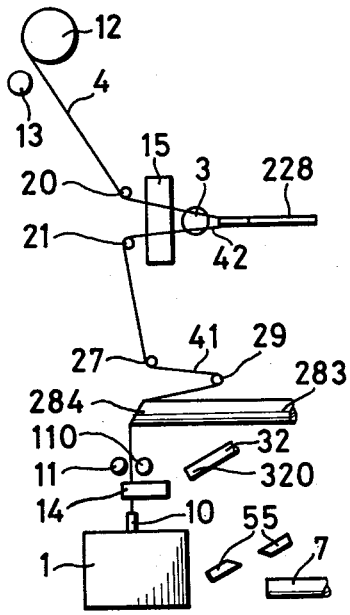
Figure 22:
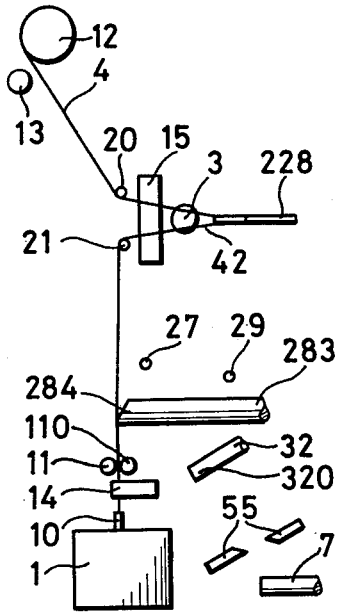

The thread 4 is now removed from the suction tube 32 and fed to the outlet tube 10. This is done either by hand or automatically. In the latter case a light barrier may be provided at the mouth 320 of the suction tube 32, which upon sensing the thread 4 feeds this by means of a pneumatic gripper (not shown, e.g., after the style of the gripper 30 in FIG. 15) to the outlet tube 10 (FIG. 21). The actual attachment of the thread is now controlled by a pushbutton (not shown) or by a light barrier (not shown) in the outlet tube 10, which becomes effective in connection with the elimination of the thread breakage. The thread-deflector member 29 releases the thread 4 (FIG. 22). For this purpose the thread-deflector member 29 is, for example, pulled away to the side so that the thread 4 is laid against the stop 291 and released (FIG. 25). A lead-in curve 116 may in that case be associated with the pressure roller 110, which introduces the thread 4 into the pinch between the draw rollers 11, 110.

The fibre feed for the spinning device 1 is switched on in coordination timewise with the release of the spare loop 41 by the thread-deflector member 29 and/or with the response of the thread monitor 14, the pressure roller 110 by release by the pin 115 is brought once more into contact with the draw-shaft 11 and the auxiliary thread-draw device 3 is set in action. The thread 4 is now drawn off by the draw rollers 11, 110 and the auxiliary thread-draw device 3 (FIG. 22). The knotting device 15 is set in action by a time control or a thread monitor 16 (see FIGS. 1 to 5) when the point of attachment 44 lies in the loop 42 on the side facing the auxiliary thread-draw device 3. The auxiliary thread-draw device 3 is made mechanical in the form of draw rollers if a thicker thread is to be spun. On the other hand, if only fine threads are being spun an auxiliary thread-draw device 3 formed as a suction is adequate (FIG. 25).

Figure 23:
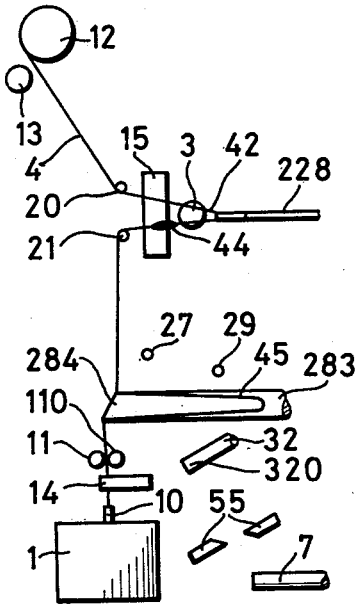
Figure 24:
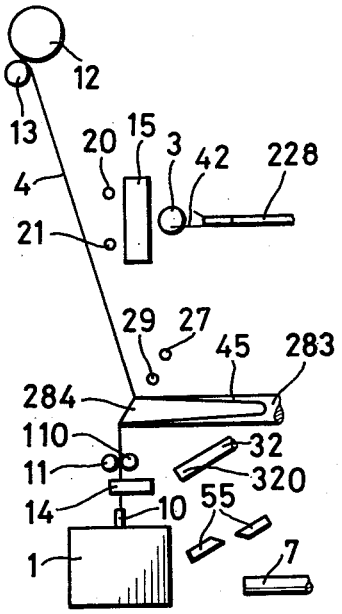

When the point of attachment 44 has reached the loop 42 in the zone of the auxiliary thread-draw device 3 the flow of suction air in the suction tube 283 is switched on by any suitable means. A switch such as sensor 16 of FIGS. 1–5 could be used for activating the flow of air. In order to bring the thread 4 to rest in the knotting device 15 during the knotting operation the thread 4 drawn off by the draw-rollers is stored intermediately in the suction tube 283 in the form of a spare loop 45 (FIG. 23). The bobbin 12 is lowered onto its driving roller 13 in coordination timewise with the knotting process via a time control (not shown), which is done, for example, by means of a supporting element 120 (FIG. 25). The knotted thread 4 is then pulled out of the knotting device 15, whilst the loop 42 gets carried away by the auxiliary thread-draw device 3 (FIG. 24). In the case of a mechanical auxiliary thread-draw device 3 it is brought to rest for the duration of the knotting process.

The device in accordance with the invention may as the foregoing description shows, be modified within the scope of the invention in many ways. Thus, individual elements of the devices described may be mutually exchanged or substituted by technical equivalents. For example, the pneumatic gripper 30 (FIGS. 6 to 15) may be substituted by a mechanical gripper taking the form of tongs. But the method of operation too may be modified. For example, the thread monitor 14 may be formed as a thick-and-thin-spot monitor which upon the occurrence of such a defective point in the thread 4 generates a thread breakage, whereupon thread attachment is effected in the way described.

But with the device in accordance with the invention it is also possible to eliminate such a defective point in the thread 4 without a thread breakage being generated. For this purpose it is necessary to change the run of the thread very slightly. In the case of the embodiments shown in FIGS. 1 to 5 and 16 to 25 the thread 4 in that case must during normal drawing be led through the knotting device 15.

The knotting device 15 may in that case as already described, by movable to and fro in the direction of the arrow 155 (FIG. 25) so that it is brought into the region of the loop 42 only for the knotting operation. Between the knotting device 15 and the bobbin 12 lies another spare loop 40 (FIGS. 2-5). The loop 42 and the spare loop 40 are built up after completion of the knotting process, in which case the spare loop 45 can give up its length of thread in favour of the loops 40 and 42. The thread-deflector member 228 advantageously exhibits an approach-bevel 229 against which the thread 4 slides along when the thread-deflector 228 is brought into the run of the thread. Hence the thread 4 is threaded automatically into the thread-deflector member 228. The thread-deflector member 25 (FIGS. 1 to 5) may be similarly formed, but the thread-deflector member 25 may also like the thread-deflector member 29 (FIG. 25) be retractable sideways out of the run of the thread while it is being moved on the other side of the run of the thread.

Hence, during the spinning process the thread 4 on its way from the spinning device 1 to the bobbin 12 passes the thread monitor 14 which responds also to thick and thin spots, the draw-rollers 11, 110 and also the knotting device 15. When the thread monitor 14 establishes a faulty spot in the thread 4 this is brought — like the point of attachment 44 — up to and into the region of the auxiliary thread-draw device 3, whereupon the fault gets eliminated in the way described as in the case of the thread attachment. The knotting device 15 comes into action whilst the spare loop 40 is run down and a spare loop 45 gets built up (FIGS. 1 to 5). After completion of the knotting process the loop 42 with the point of fault is severed and carried away by the auxiliary thread-draw device 3. After the knotting process is finished the thread 4 is again led through the knotting device 15 and a spare loop 40 is built up, whilst the spare loop 45 is collapsed again.

Similarly thick and thin spots in the thread 4 can be eliminated in the case of the device in accordance with FIGS. 16 to 25.

In the case of the device in accordance with FIGS. 6 to 15 elimination of thick and thin spots without a new attachment of the thread is equally possible, yet in this case a thread breakage is produced. The normal run of the thread for this purpose is shown in FIG. 8. But in addition between the knotting device 150 and the bobbin 12 there is a spare loop 40 as shown in FIGS. 1 to 5. When the thread monitor 14 establishes an abnormality in the thread 4 a buildup of the spare loop 40 begins and the thread 4 with the point of fault is taken up by the gripper 30. Then in accordance with FIG. 10 the thread 4 is deflected into a loop 46 and severed by means of the thread-severing device 5. The thread ends 460 and 461 are therefore held by the suction 31 and by the gripper 30 (FIG. 11).

The further operational steps are exactly as in connection with thread attachment (FIGS. 12 to 14). Subsequent to knotting the spare loop 40 is again rebuilt.

Instead of buildup and rundown of the spare loop 40 the bobbin may also be lifted off the driving roller 13, for which purpose the supporting element 120 has merely to be developed in a suitable way so that it can be driven in both directions.

Naturally it is possible to provide the device in accordance with the invention on every spinning unit. But it is particularly advantageous to accommodate the object of the invention on a carriage (not shown) which can travel along the machine and then in each case is automatically run along to the spinning unit at which a fault has occurred.

The object of the invention enables points of fault in the thread 4 of the most different kind and cause to be eliminated simply and by simple means and thereby separate rewinding processes with yarn cleaning to be avoided.

While a preferred embodiment of the invention has been described using specific terms, such description is for illustrative purposes only, and it is to be understood that changes and variations may be made without departing from the spirit or scope of the following claims.

What is claimed is:

1. A method of eliminating an irregularity in yarn being produced in a spinning element of an open end spinning machine and being wound on a bobbin utilizing a knotting device, said method comprising:

positioning said knotting device in the normal running path that said yarn travels from said spinning element to said bobbin and guiding said yarn through said knotting device;

deflecting said yarn extending between said knotting device and said spinning element from the normal path upon the occurrence of an irregularity in the yarn;

severing said deflected position of said yarn removing said irregularity therefrom;

gripping said resulting ends of said severed yarn with gripping devices;

moving one of said gripping devices to adjacent said knotting device for inserting a resulting end portion of said yarn being delivered from said spinning element into said knotting device;

knotting said resulting end portion of said yarn with said yarn extending through said knotting device; and removing the severed portion of said yarn containing said irregularity.

2. The method as set forth in claim 1 further comprising:

storing said yarn delivered by said spinning element intermediately during said knotting process; and after completion of said knotting process reducing said intermediately stored yarn length until completely consumed.

3. The method as set forth in claim 2 further comprising:

said reduction of said intermeditately stored length of yarn occurs by decreasing the yarn take-off from said spinning element.

4. The method as set forth in claim 1 further comprising:

storing a reserve loop between said knotting device and said bobbin prior to said knotting process taking place and reducing said reserve loop during said knotting process.

5. The method as set forth in claim 1 wherein:

said one gripping device gripping said resulting end portion utilizes a pneumatic tube; and pivoting said pneumatic tube above said knotting device for inserting said resulting end portion of said yarn into said knotting device.

6. An apparatus for eliminating an abnormality in yarn being produced by a spinning element of an open end spinning device and being wound on a bobbin, said device comprising:

a knotting device disposed in the normal running path of said yarn which extends from said spinning element to said bobbin;

means for deflecting a portion of said yarn leading to said knotting devce responsive to the occurrence of an abnormality in said yarn from said normal running path of said yarn to a deflected position;

means for severing said yarn in said deflected portion removing said abnormality and producing two resulting ends, said yarn end extending from said bobbin being retained in said knotting device;

gripping means for gripping said resulting end extending from said spinning element while in said deflected position; and means for pivoting said gripping means from said deflected position to adjacent said knotting device inserting said resulting end extending from said spinning element into said knotting device for being knotted to said end extending from said bobbin.

7. The device as set forth in claim 6 further comprising:

means for deflecting said yarn between said bobbin and said knotting device forming a loop; and means for running down said loop positioned between said bobbin and said knotting device during said knotting process.

* * * * *